US006913176B1

(12) United States Patent
Buscemi

(10) Patent No.: US 6,913,176 B1
(45) Date of Patent: Jul. 5, 2005

(54) UTILITY BELT FOR BABY EQUIPMENT

(76) Inventor: Colette Buscemi, 617 S. Vine St., Park Ridge, IL (US) 60068

( * ) Notice: Subject to any disclaimer, the term of this patent is extended or adjusted under 35 U.S.C. 154(b) by 306 days.

(21) Appl. No.: 10/050,264

(22) Filed: Jan. 16, 2002

(51) Int. Cl.[7] ..... A45C 1/04

(52) U.S. Cl. ..... 224/665; 224/682; 224/901.4; 224/901.8

(58) Field of Search ..... 224/663, 664, 224/665, 676, 677, 681, 682, 684, 904, 901.4, 224/901.6, 901.8, 163; 383/17

(56) References Cited

U.S. PATENT DOCUMENTS 1,478,497 A * 12/1923 Welch ..... 224/683
D196,542 S * 10/1963 Zelnick ..... D3/228
4,562,620 A * 1/1986 Oliver, Jr. ..... 24/163 K
4,580,667 A * 4/1986 Herwood ..... 190/110
4,753,377 A * 6/1988 Poluhowich ..... 224/163
4,907,729 A * 3/1990 Hess, III ..... 224/682
4,957,231 A * 9/1990 Kalisher ..... 224/583
5,240,156 A * 8/1993 Sicotte et al. ..... 224/583
5,288,150 A * 2/1994 Bearman ..... 383/38
5,497,923 A * 3/1996 Pearson et al. ..... 224/682
5,558,440 A * 9/1996 Miller ..... 383/87
5,683,022 A * 11/1997 Evans ..... 224/583
6,073,823 A * 6/2000 Gordon ..... 224/661

* cited by examiner

*Primary Examiner*—Stephen K. Cronin
(74) *Attorney, Agent, or Firm*—Arthur I. Degenholtz

(57) ABSTRACT

A belt for carrying baby equipment has an insulated, generally cylindrical pocket for carrying a feeding bottle or a feeding cup and a generally rectangular pocket for carrying a telephone. The rear of the belt has an elongated rectangular pocket which has a top opening and a pair of side opening for storing a changing pad and clean diapers. The inside of the belt has a pair of pockets for storage of various items. The cylindrical pocket and the rectangular pocket are adjustably mounted on the belt. The upper edge of the rear pocket is elasticized to combine security with easy access.

10 Claims, 11 Drawing Sheets

UTILITY BELT FOR BABY EQUIPMENT

FIELD OF THE INVENTION

The present invention relates generally to the field of baby equipment and more particularly to a utility belt for baby equipment.

BACKGROUND OF THE INVENTION

When traveling with a baby, parents and other caregivers often resort to various devices in order to carry items required for baby care such as feeding bottles, feeding cups, changing pads and diapers. Typical devices include various handbags, shoulder bags and backpacks. In addition to items required for baby care there is typically a need for ready access to a cellular telephone. Each of these devices is subject to various disadvantages. The use of a shoulder bag or a handbag interferes with holding and caring for a baby. The use of a shoulder bag or a handbag in addition usually interferes with physical activities such as walking or hiking. The use of a backpack renders the baby equipment being carried unavailable until the backpack is removed from the user's back. The use of the backpack for carrying baby equipment also prevents the use of a backpack type of baby carrier. With a conventional backpack or handbag there is often a need to take off the backpack or place the handbag down. If the user is at a park, the baby's stroller or the park bench becomes the resting place for the backpack or shoulder bag. This is not only inconvenient but is also unsafe. The stroller may become weighed down and fall or the contents of these bags, such as the user's wallet or cell phone may be stolen when left unattended.

Despite the various developments in the prior art there remains a need for an apparatus which enables a user to carry baby equipment in a convenient hands-free manner.

OBJECTS AND SUMMARY OF THE INVENTION

It is an object of the present invention to provide a utility belt for baby equipment which facilitates carrying baby equipment in a hands-free manner.

Another object of the present invention is to provide a utility belt for baby equipment which can be conveniently worn on the waist of a user during walking or hiking.

Another object of the present invention is to provide a utility belt for baby equipment which can be easily adjusted to fit an individual user.

Another object of the present invention is to provide a utility belt for baby equipment which can accommodate women who continue to lose weight after giving birth.

Another object of the present invention is to provide a utility belt for baby equipment which can carry a feeding bottle, diapers and a changing pad in a convenient manner.

Another object of the present invention is to provide a utility belt for baby equipment which can carry a sipping cup without spilling the contents.

Another object of the present invention is to provide a utility belt for baby equipment which can carry a cellular telephone.

Another object of the present invention is to provide a utility belt for baby equipment which is easily adjustable for both right-handed and left-handed users.

Another object of the present invention is to provide a utility belt for baby equipment which can store soiled diapers in a convenient manner.

Yet another object of the present invention is to provide a utility belt for baby equipment which comprises a relatively small number of component parts, which can be manufactured economically in volume, resulting in a relatively low overall cost.

The foregoing and other objects and advantages of the invention will appear more clearly hereinafter.

In accordance with the present invention there is provided a utility belt for baby equipment which includes an elongated belt member the outer surface of which includes an elongated strip of loop material which forms part of a hook and loop fastener. The inner surface of the belt includes a band of hook material disposed proximate to an end of the belt member. The hook material engages the loop material forming a closure to adjustably encircle the waist of a user.

A generally cylindrical, thermally insulated pocket is adjustablely mounted on the loop material on the front portion of the belt member for the storage of a feeding bottle. The cylindrical pocket includes a pair of fabric layers which are separated by a foam layer thereby providing thermal insulation for the storage of the feeding bottle. An elastic band is mounted on the upper edge of the cylindrical pocket for the purpose of securing a feeding bottle which has been placed in the pocket. The cylindrical pocket is secured to the belt by a portion of hook material which is mounted on the back portion of the pocket.

A telephone pocket it is also adjustably mounted on the elongated strip of loop material. The telephone pocket is formed as a generally rectangular unit which has a relatively flat back portion. The back portion includes a band of hook material which is attached to the loop material on the belt. The telephone pocket includes a flap which is secured to the front portion of the pocket by a hook and loop fastener.

The telephone pocket and the bottle pocket are normally mounted proximate to the ends of the belt member so that when a user places the belt member around his or her waist, the telephone pocket and the cylindrical bottle pocket are on the exterior of the belt and within easy hand reach.

The positions of the telephone pocket and the bottle pocket can be readily adjusted relative to the belt and the positions of the telephone pocket and the bottle pocket may also be interchanged for the convenience of right-handed or left-handed users.

The back portion of the belt includes an elongated pocket formed by a mesh panel. The elongated pocket has openings along a top edge and along two opposite side edges thereby providing ready access to materials stored in the pocket. The elongated pocket contains a changing pad and a supply of diapers. The inner surface of the belt includes a pair of pockets, one of which is lined with plastic film. One of pockets, which is made of material, is proportioned expressly for storage of valuables such as: money, a wallet, driver's license and identification.

DESCRIPTION OF THE DRAWINGS

Other important objects and advantages of the invention will be apparent from the following detailed description of the invention taken in connection with the accompanying drawings in which.

DETAILED DESCRIPTION OF THE INVENTION

Figure 1:
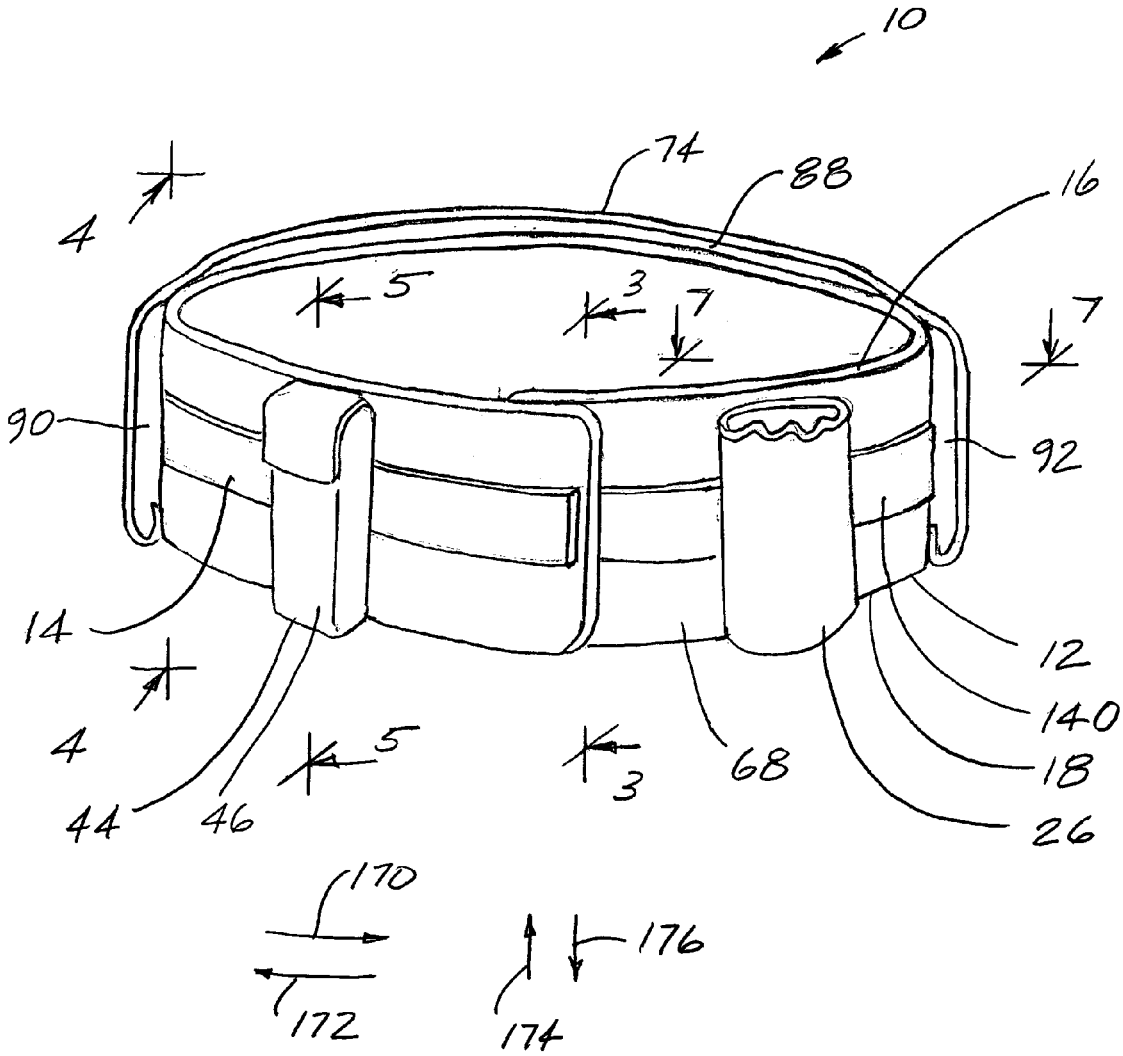
FIG. 1 is a perspective view showing the front of a utility belt for baby equipment in accordance with the present invention.

With reference to the drawings, in which like reference numbers designate like or corresponding parts throughout, there is shown in FIG. 1 a utility belt for baby equipment, generally designated by reference number 10, made in accordance with the present invention, which includes an elongated belt member 12 the outer surface of which includes a pair of elongated strips of loop material 14, 140 which forms of part of a hook and loop fastener. The loop material 14,140 is disposed longitudinally with respect to the belt member 12 and is generally centered between the top and bottom edges 16, 18 of the belt member 12. The inner surface 20 of the belt member 12 includes a band of hook material 22 disposed in a generally transverse direction relative to the belt member 12 and disposed proximate to the end 24 of the belt member 12. The band of hook material 22 engages the strip of loop material 140 forming a closure which, during use, encircles the waist of a user. The upper edge 16 of the belt member 12 is generally concave while the lower edge 18 is generally convex thereby providing a shape which generally conforms to the user's body when the belt member 10 encircles the user's waist. The corners 150, 152, 154, 156 of the belt member are rounded for the user's comfort.

Figure 3:
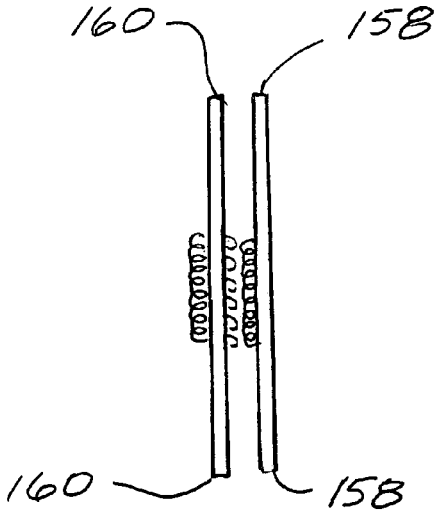
FIG. 3 is a cross-sectional view taken along the line 3—3 of FIG. 1.
Figure 4:
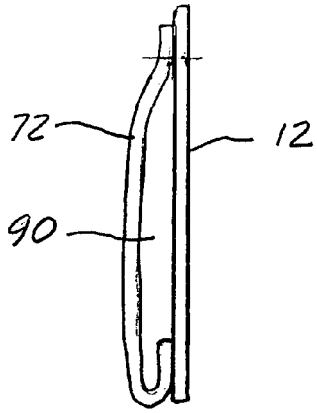
FIG. 4 is a cross-sectional view taken along the line 4—4 of FIG. 1.
Figure 5:
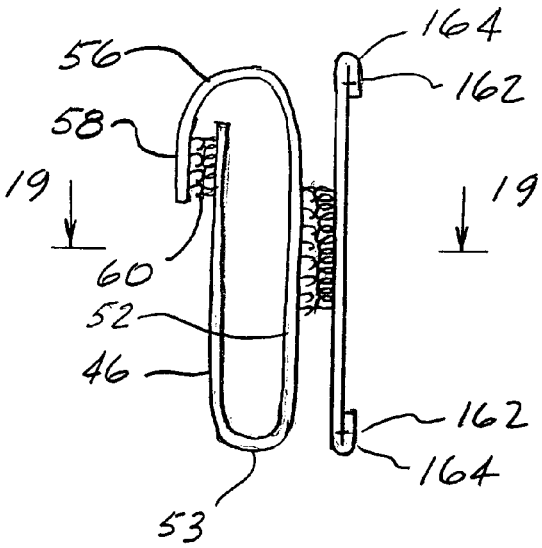
FIG. 5 is a cross-sectional view taken along the line 5—5 of FIG. 1.
Figure 6:
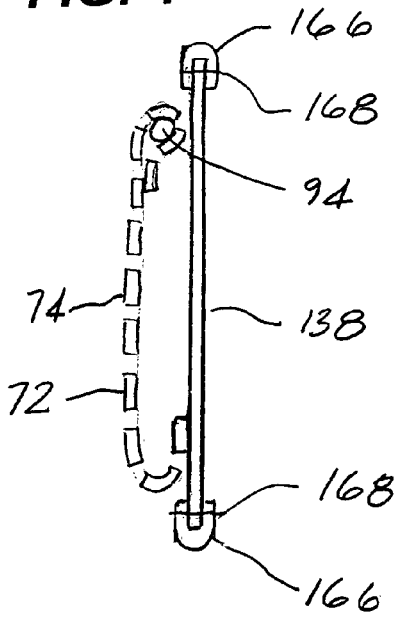
FIG. 6 is a cross-sectional view taken along the line 6—6 of FIG. 2.
Figure 7:
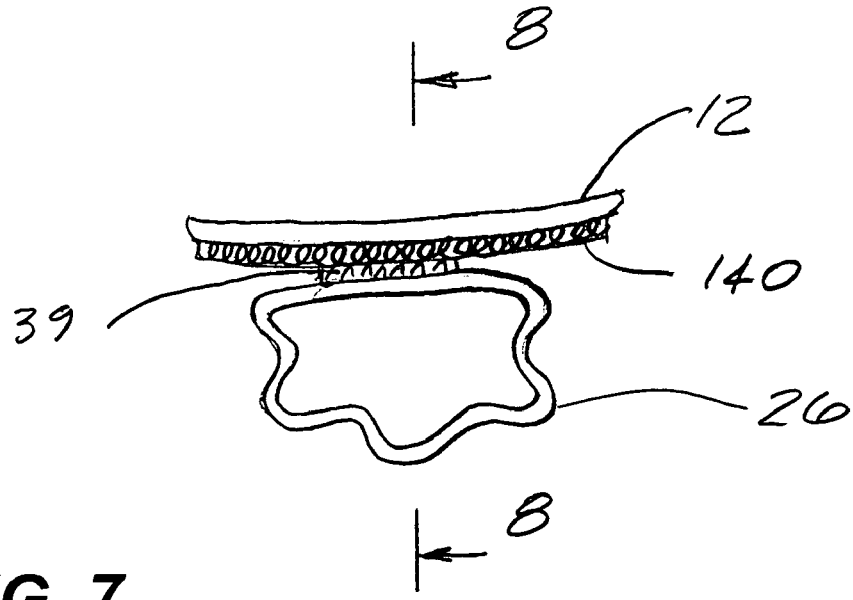
FIG. 7 is a fragmentary top plan view taken along the line 7—7 of FIG. 1.

The belt member 10 is preferably made of Nylon, or other fabric, which is coated with rubber such as Neoprene. Peripheral edges 158, 160 may be simply cut to shape as shown in FIG. 3 or, alternatively, folded and stitched 162 to form a hem 164 as shown in FIG. 5. The peripheral edges may be covered by piping 166 which is attached by stitching or other conventional techniques as is shown in FIG. 6.

The coated fabric combines the desired combination of characteristics of stiffness and flexibility with the ability to be easily cleaned by washing.

Figure 8:
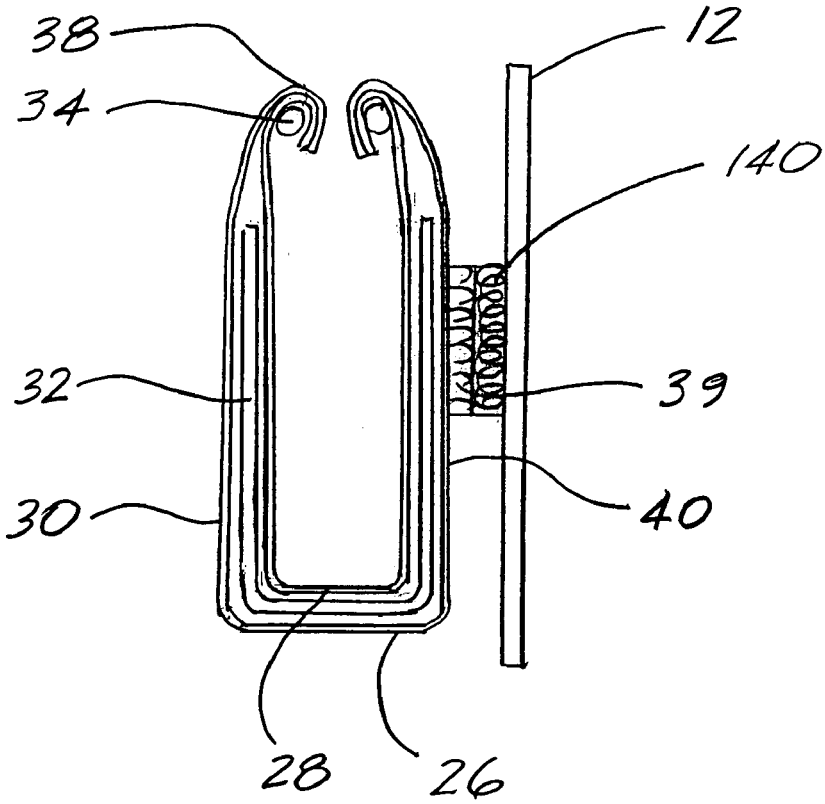
FIG. 8 is a cross-sectional view taken along the line 8—8 of FIG. 7.
Figure 9:
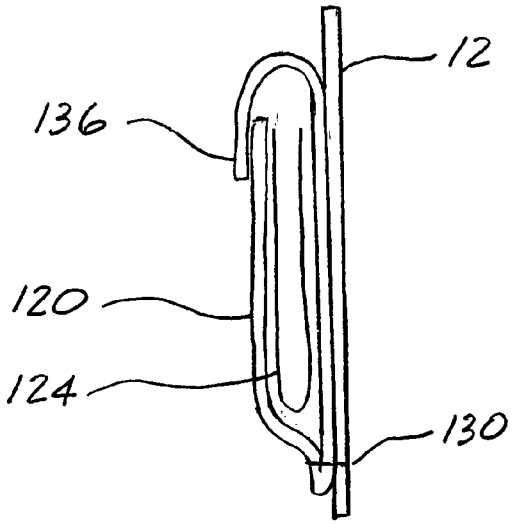
FIG. 9 is a cross-sectional view taken along the line 9—9 of FIG. 2.
Figure 10:
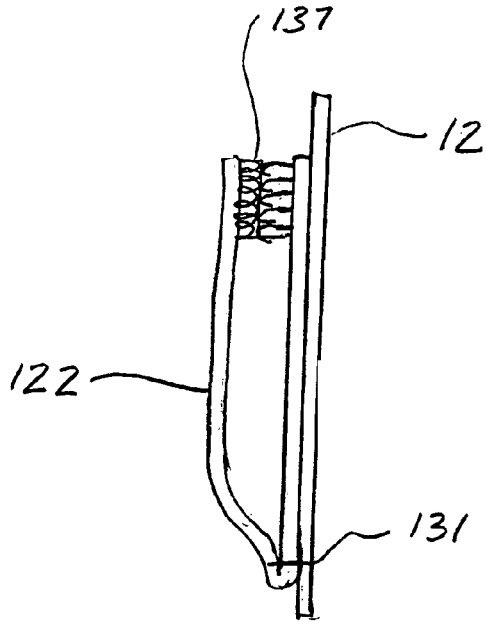
FIG. 10 is a cross-sectional view taken along the line 10—10 of FIG. 2.
Figure 19:
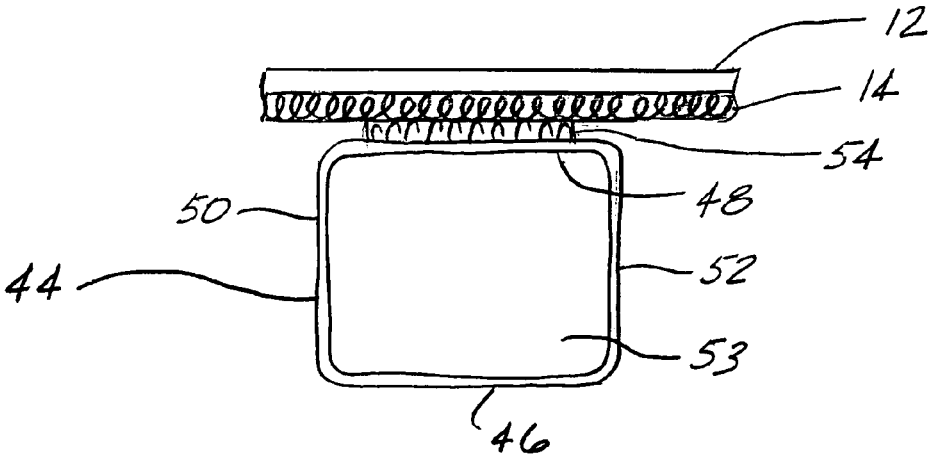
FIG. 19 is a cross-sectional view taken along the line 19—19 of FIG. 5.

A generally cylindrical pocket 26, or receptacle, is adjustablely mounted on the loop material 140. The cylindrical pocket 26 includes a pair of fabric layers 28, 30 which are separated by a foam layer 32 thereby providing an insulated pocket for the storage of a feeding bottle. As is best shown in FIG. 8, an elastic band 34 is mounted on the upper edge 38 of the cylindrical pocket 26 for the purpose of securing a feeding bottle which, during use, may be placed in the pocket 26. The cylindrical pocket 26 is secured to the belt member 12 by a portion of hook material 39 which is mounted on the back portion 40 of the pocket 26 and which engages the loop material 140 on the belt member 12. The cylindrical pocket 26 is elongated to generally conform to the typical shape of a feeding bottle.

Figure 18:
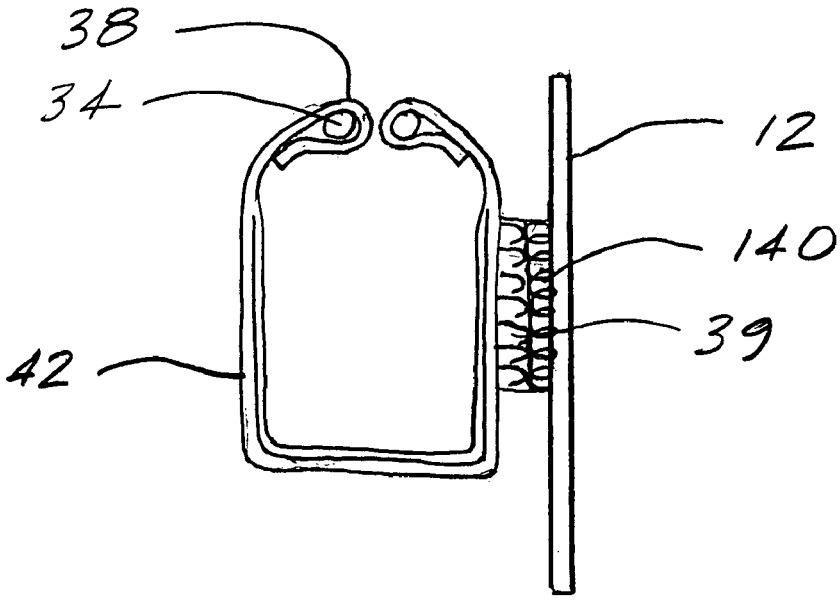
FIG. 18 is a cross-sectional view similar to FIG. 8 showing an alternative receptacle adapted for the storage of a sipping cup.

An alternative cylindrical pocket 42 of identical construction which has a relatively larger diameter and a relatively shorter height as compared with the cylindrical pocket 26, which has been described above, is shown in FIG. 18. The alternative cylindrical pocket 42 generally conforms to the overall configuration of a sipping cup. The cylindrical pockets 26, 42 can be interchanged on the belt member 12 to suit the progress of a baby from the use of a feeding bottle to a sipping cup.

A telephone pocket 44 is also adjustably mounted on the elongated strip of loop material 14. The telephone pocket 44 is formed as a generally rectangular pocket having a front panel 46, a back panel 48 and a pair of spaced apart side panels 50, 52 and a bottom panel 53. The back panel 48 is relatively flat and includes a band of hook material 54, which is attached to the loop material 14 on the belt member 12. An upper portion 56 of the back panel 48 extends to form a flap 58 which is secured to the front panel 46 of the pocket 44 by a hook and loop fastener 60.

Figure 11:
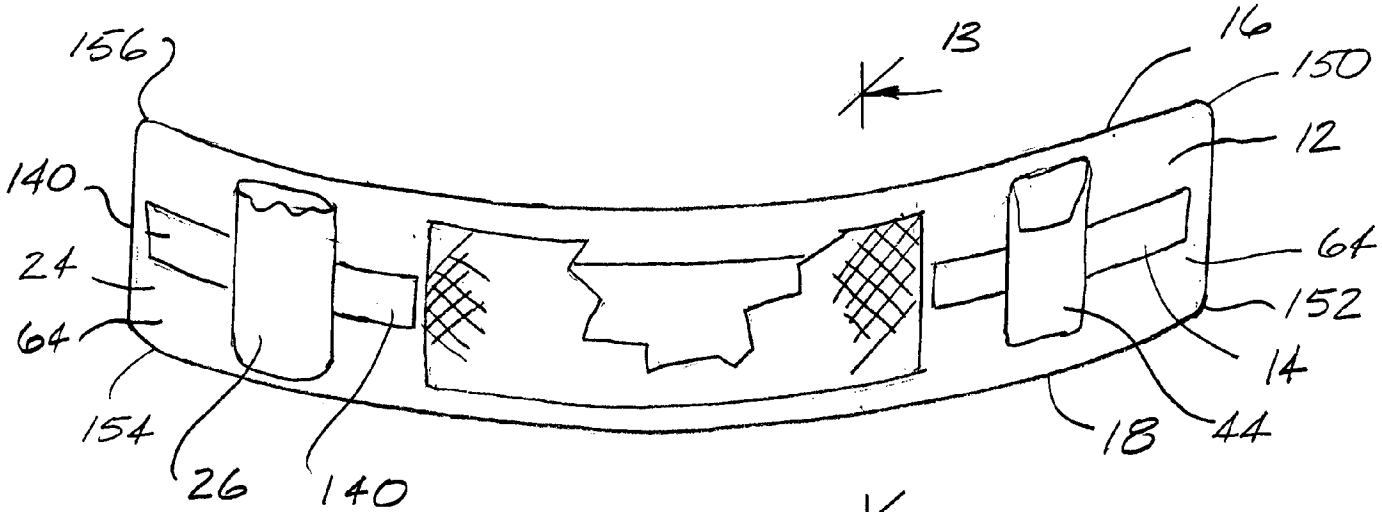
FIG. 11 is a plan view of the utility belt for baby equipment of FIG. 1 in the extended position showing the outside surface of the utility belt with a portion shown broken away to show details of internal construction.
Figure 12:
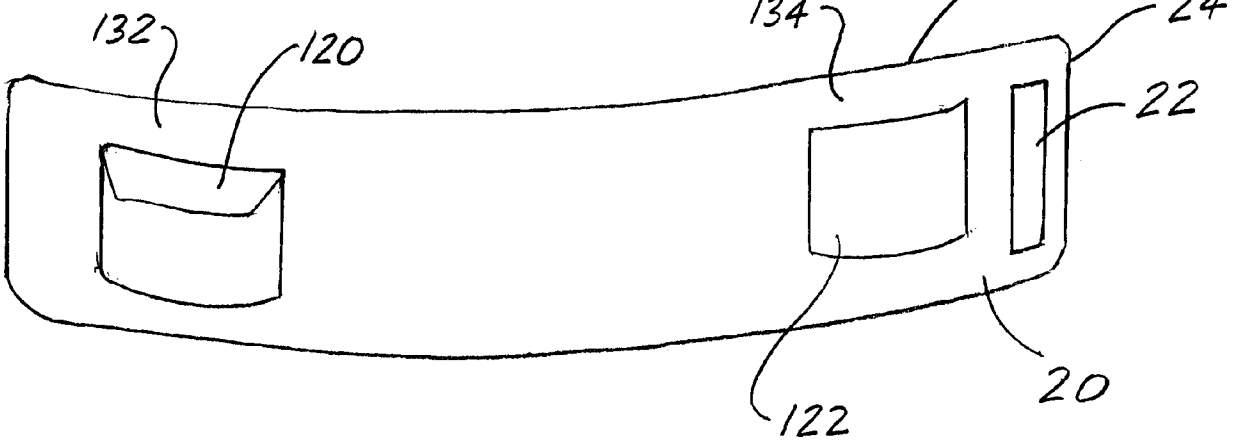
FIG. 12 is a plan view of the utility belt for baby equipment of FIG. 1 with the belt shown in the extended position and showing the inside surface of the utility belt.

As is shown in FIGS. 1 and 11, the rectangular telephone pocket 44 and the cylindrical bottle pocket 26 are normally mounted proximate to the ends 64 of the belt member 12 so that when a user places the belt member 12 around his or her waist, the telephone pocket 44 and the bottle pocket 26 are on the exterior 68 of the belt member 12 and within easy reach.

The position of the telephone pocket 44 and the bottle pocket 26 can be readily adjusted both longitudinally, in the directions shown by the arrows 170, 172, and transversely, in the directions shown by the arrows 174, 176, relative to the belt member 12. The positions of the telephone pocket 44 and the cylindrical bottle pocket 26 may be also may be interchanged for the convenience of right-handed or left-handed users.

The back portion 70 of the belt member 12 includes an elongated pocket 72, which forms a key feature of the present invention. The elongated pocket 72 is formed by a mesh panel 74 which is generally rectangular but which has curved upper and lower edges 76, 78 which generally conform to the curvature of the upper and lower edges 16, 18 of the belt member 12. The upper corners 80, 82 of the mesh panel 74 and the lower edge 84 of the mesh panel 74 are attached to the belt member 12 by stitching 178 or other conventional attachment means thereby leaving an upper elongated opening 88 and a pair of side openings 90, 92 between the mesh panel 74 and the belt member 12. The upper edge 76 of the mesh panel 74 has an elastic band 94 thereby providing a closure, which retains materials stored in the elongated pocket 72.

Figure 2:
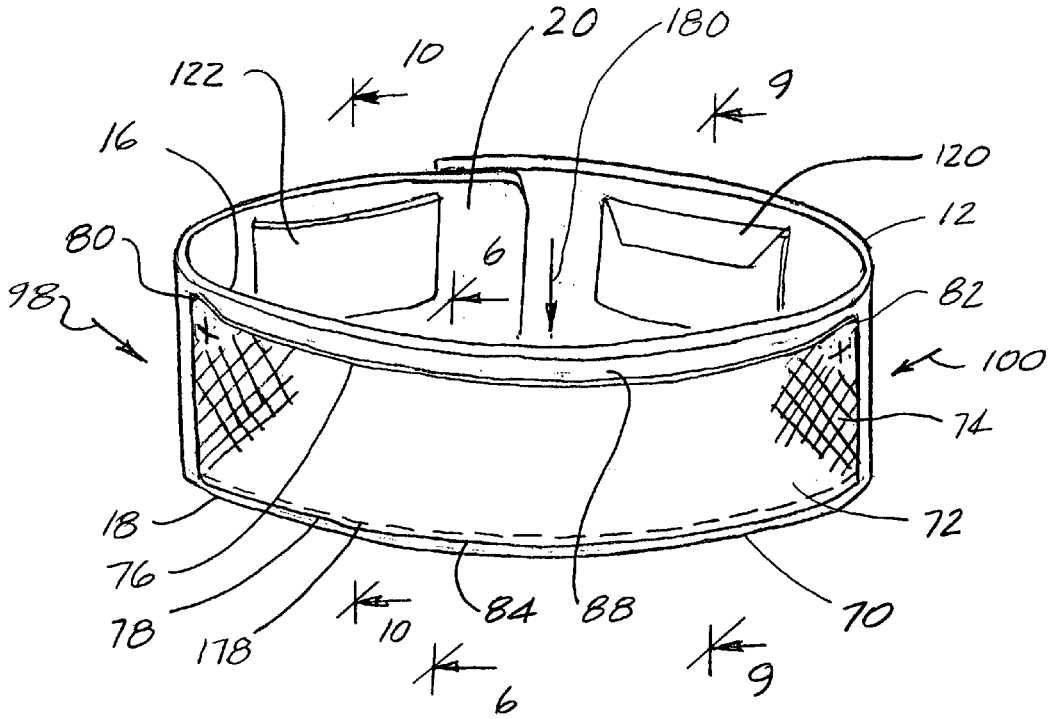
FIG. 2 is a perspective view showing the rear of the utility belt for baby equipment of FIG. 1.

The arrangement of openings 88, 90, 92 allows a user to access materials stored in the elongated pocket 72 from the top, in the direction shown by the arrow 180 in FIG. 2, and from either side in the directions shown by the arrows 98, 100 thereby providing ready access to materials stored in the elongated pocket even though this pocket 72 is located on the rear portion 70 of the belt member 12.

Figure 13:
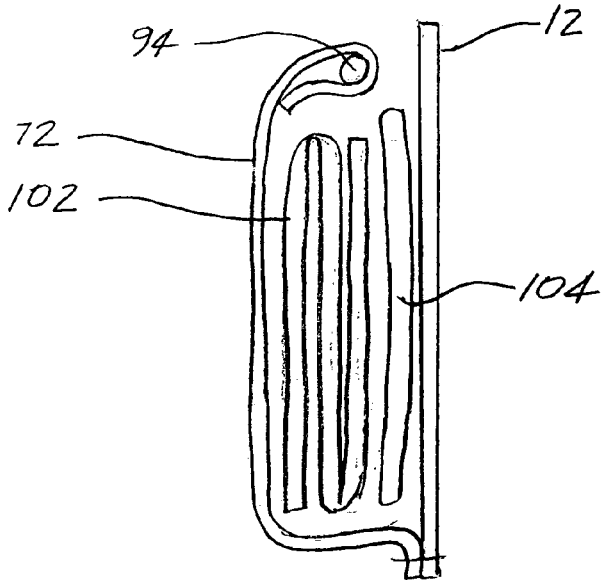
FIG. 13 is a cross-sectional view taken along the line 13—13 of FIG. 11.
Figure 14:
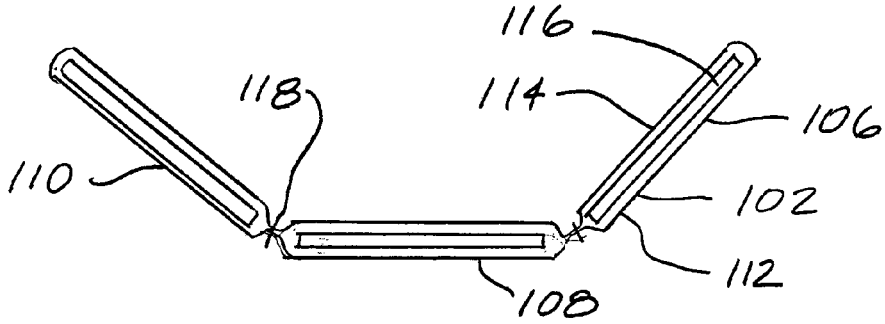
FIG. 14 is a side view of the changing pad which is normally stored in the utility belt for baby equipment of FIG. 1 with the changing pad shown removed from the utility belt.
Figure 15:
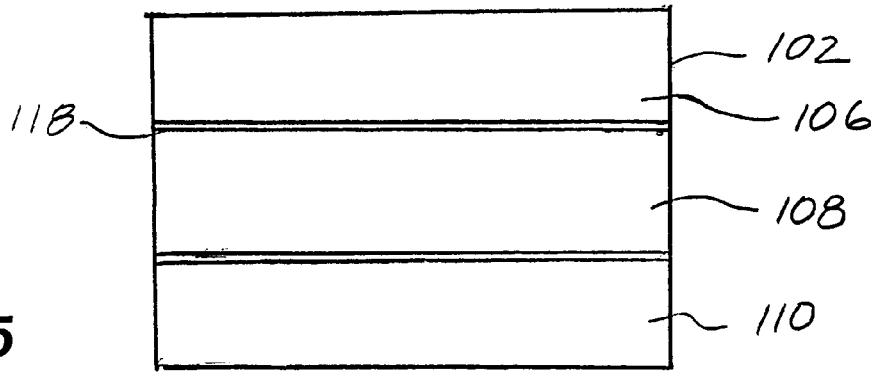
FIG. 15 is a top plan view of the changing pad of FIG. 14.

The elongated pocket 72 typically contains a changing pad 102 and a supply of diapers which are indicated schematically by the rectangle 104 in FIG. 13. The changing pad 102, which is best shown in FIGS. 14 and 15, includes three generally cylindrical panels 106, 108, 110 which are formed by a pair of fabric layers 112, 114 which are separated by a layer of foam 116. The fabric layers 112, 114 are attached by stitching 118 to form the pad 102 which is easily folded to fit into the elongated pocket 72. The changing pad 102 is easily removed from the elongated pocket 72 for use during the process of changing a baby's diaper.

The inner surface 20 of the belt member 12 includes a pair of rectangular pockets 120, 122. Pocket 120 is lined with plastic film 124. The pockets 120, 122 are formed by generally rectangular panels 126, 128 which are attached to the belt member 12 by stitching 130, 131 and are located in the front portions 132, 134 of the belt member 12. The pocket 120 has a flap 136 for additional security. The pocket 122 has a hook and loop fastener 137. During use, the pockets 120, 122 are disposed between the belt member 12 and the user's body and are held closed by pressure from the belt member 12.

Figure 16:
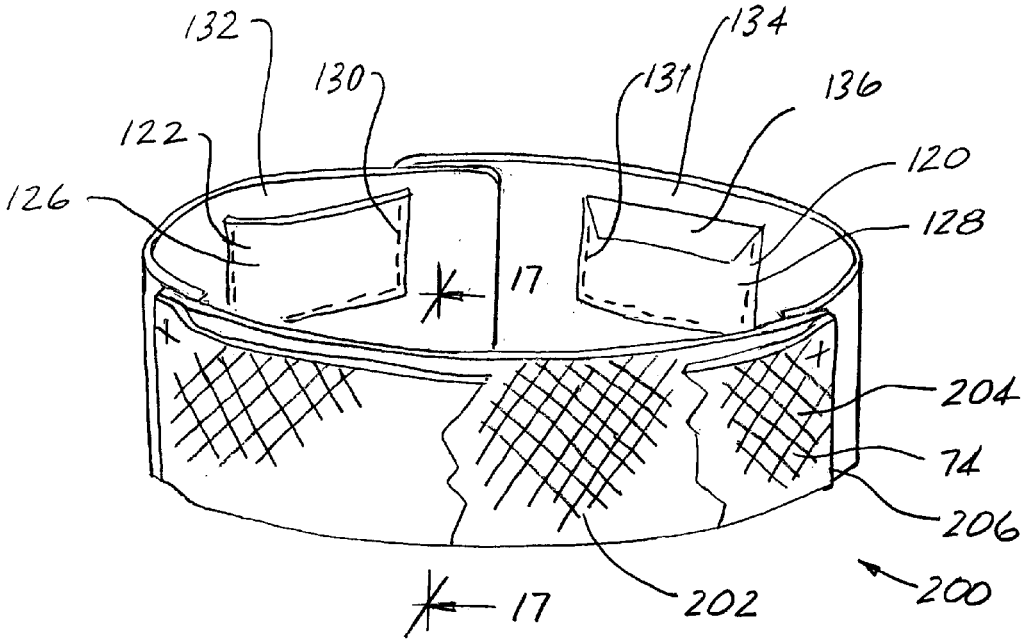
FIG. 16 is a perspective view showing the rear of an alternate embodiment of the utility belt for baby equipment of FIG. 1 with portions shown broken away to show details of internal construction.
Figure 17:
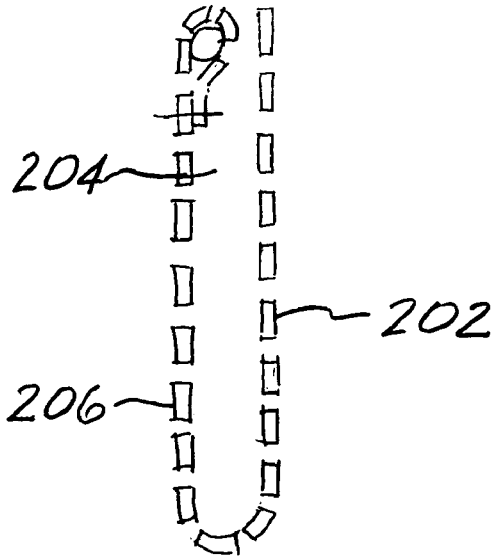
FIG. 17 is a cross-sectional view taken along the line 17—17 of FIG. 16.

In an alternative embodiment of the invention 200, shown in FIGS. 16 and 17, the solid portion of the belt member 138, shown in FIG. 6, which is next to the mesh panel 74 and which forms part of the elongated pocket 72 is replaced by a mesh panel 202 thereby providing an additional degree of flexibility and increased cooling. The access to the elongated pocket 204 formed by the mesh panel 202 and the mesh panel 206 is the same as has been previously described in connection with the elongated pocket 72 in the primary embodiment of the invention 10.

Figure 20:
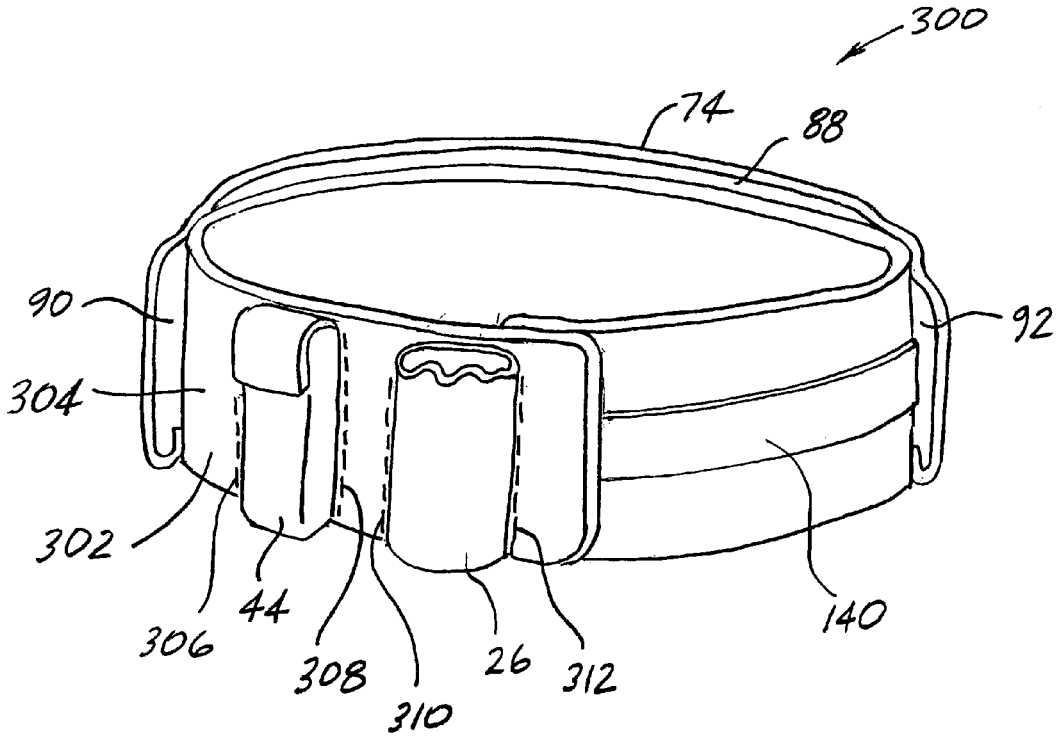
FIG. 20 is a perspective view, similar to FIG. 1, showing the front of another alternate embodiment of the invention.
Figure 21:
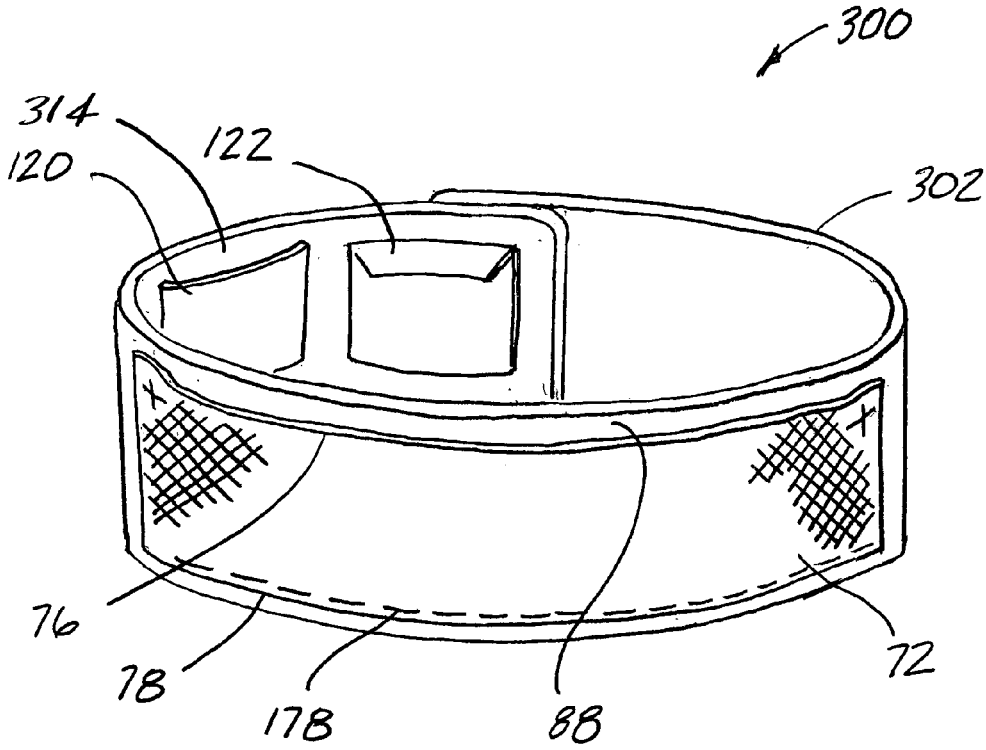
FIG. 21 is a perspective view similar to FIG. 2, showing the rear of the alternate embodiment of FIG. 20.

In another alternative embodiment of the invention 300 shown in FIGS. 20 and 21 the elongated strip of loop material 14, which is shown in FIG. 1, has been eliminated. The cylindrical pocket 26 shown in FIG. 1 is located on the left-hand portion 302 of the belt 304, when viewed as shown in FIG. 20. In the embodiment 300, the cylindrical pocket 26 and the telephone pocket 44 are each attached to the belt 304 by rows of stitching 306, 308, 310, 312 and the portions of hook material 39, 54 which were used to attach the cylindrical pocket 26 and the telephone pocket 44, respectively to the loop material 14 have been eliminated. Other details of construction of the cylindrical pocket 26 and the telephone pocket 44 are as previously described. As shown in FIG. 21, the pocket 120, shown in FIG. 2, has been moved to a position next to the pocket 122 on the portion 314 of the belt 302. The details of construction of the pockets 120, 122 are as has been previously described.

The foregoing specific embodiment of the present invention as set forth in the specification herein is for illustrative purposes only. Various deviations and modifications may be made within the spirit and scope of this invention without departing from the main theme thereof.

I claim:

1. A utility belt for baby equipment comprising:

an elongated belt member having a first end, a second end, an outer surface and an inner surface;

attachment means mounted on said belt for removable attachment of said first end and said second end of said belt member;

a first receptacle removably mounted on said attachment means;

a first panel having an upper edge, a lower edge, a first side edge and a second side edge, with said lower edge of said first panel connected to said outer surface of said belt member, with said first side edge and said upper edge intersecting to form a first corner; with said second side edge and said upper edge intersecting to form a second corner; with said first corner and said second corner each connected to said belt member thereby forming openings between said first panel and said outer surface of said belt member along said first side edge of said first panel, along said second side edge of said first panel and along said upper edge of said first panel in which said upper edge of said first panel further comprises:

elastic means.

2. The utility belt for baby equipment as claimed in claim 1 in which said attachment means comprises:

a flexible loop member.

3. The utility belt for baby equipment as claimed in claim 1 in which said second attachment means comprises:

a flexible hook member.

4. The utility belt for baby equipment as claimed in claim 1 in which said first receptacle is flexible and generally cylindrical.

5. The utility belt for baby equipment as claimed in claim 4 in which said first receptacle has a generally circular bottom.

6. The utility belt for baby equipment as claimed in claim 1 in which said belt member comprises:

an upper edge;

a lower edge, and a pair of side edges.

7. The utility belt for baby equipment as claimed in claim 6 in which said belt member further comprises:

a generally concave upper edge, and a generally convex lower edge.

8. The utility belt for baby equipment as claimed in claim 6 in which said side edges of said belt member further comprise:

rounded corners.

9. A utility belt for baby equipment comprising:

an elongated belt member having a first end, a second end, an outer surface and an inner surface;

attachment means mounted on said belt for removable attachment of said first end and said second end of said belt member;

a first flexible receptacle mounted on said elongated belt member;

a first flexible panel having an upper edge, a lower edge, a first side edge and a second side edge, with said lower edge of said first panel connected to said outer surface of said belt member, with said first side edge and said upper edge intersecting to form a first corner; with said second side edge and said upper edge intersecting to form a second corner; with said first corner and said second corner each connected to said belt member thereby forming openings between said first panel means and said outer surface of said belt member along said first side edge of said first panel, along said second side edge of said first panel and along said upper edge of said first panel means.

10. A utility belt for baby equipment comprising:

an elongated belt member having a first end, a second end, an outer surface and an inner surface;

attachment means mounted on said belt for removable attachment of said first end and said second end of said belt member;

a first receptacle removably mounted on said attachment means;

a first panel having an upper edge, a lower edge, a first side edge and a second side edge, with said lower edge of said first panel connected to said outer surface of said belt member, with said first side edge and said upper edge intersecting to form a first corner; with said second side edge and said upper edge intersecting to form a second corner; with said first corner and said second corner each connected to said belt member thereby forming openings between said first panel and said outer surface of said belt member along said first side edge of said first panel, along said second side edge of said first panel and along said upper edge of said first panel in which said first receptacle has an upper edge in which said upper edge of said first receptacle further comprises:

elastic means.

* * * * *